US010987949B2

(12) United States Patent
Nishimura et al.

(10) Patent No.: US 10,987,949 B2
(45) Date of Patent: Apr. 27, 2021

(54) DE-CURLING DEVICE AND IMAGE FORMING APPARATUS INCLUDING SAME

(71) Applicant: KYOCERA Document Solutions Inc., Osaka (JP)

(72) Inventors: Takatoshi Nishimura, Osaka (JP); Hiroatsu Tamai, Osaka (JP); Hiroyuki Ueda, Osaka (JP); Takeshi Watanabe, Osaka (JP); Susumu Hiroshima, Osaka (JP); Noriaki Ozawa, Osaka (JP); Toyotsune Inoue, Osaka (JP)

(73) Assignee: KYOCERA Document Solutions Inc.

( * ) Notice: Subject to any disclaimer, the term of this patent is extended or adjusted under 35 U.S.C. 154(b) by 0 days.

(21) Appl. No.: 16/126,211

(22) Filed: Sep. 10, 2018

(65) Prior Publication Data

US 2019/0077168 A1 Mar. 14, 2019

(30) Foreign Application Priority Data

Sep. 14, 2017 (JP) ..... JP2017-176748

(51) Int. Cl.
*B41J 2/01* (2006.01)
*B41J 11/00* (2006.01)
(Continued)

(52) U.S. Cl.
CPC ..... *B41J 11/0005* (2013.01); *B41J 11/0035* (2013.01); *B65H 29/70* (2013.01);
(Continued)

(58) Field of Classification Search
None
See application file for complete search history.

(56) References Cited

U.S. PATENT DOCUMENTS 5,287,157 A 2/1994 Miyazato et al.
9,144,965 B2 * 9/2015 Dim ..... B41F 13/02
(Continued)

FOREIGN PATENT DOCUMENTS

JP 4-338060 11/1992
JP 6136789 B2 * 5/2017

OTHER PUBLICATIONS

Kurosu, Shigetaka, Image Forming Apparatus, Mar. 23, 2015, Japan (Year: 2015).*

*Primary Examiner* — Erica S Lin
*Assistant Examiner* — Tracey M McMillion
(74) *Attorney, Agent, or Firm* — Gerald E. Hespos; Michael J. Porco; Matthew T. Hespos

(57) ABSTRACT

A de-curling device de-curls a sheet and includes an endless belt, a de-curling roller, a nip width adjusting mechanism, and a belt tension adjusting mechanism. The endless belt is looped around a pair of supporting rollers. The de-curling roller is provided between the pair of supporting rollers and has a first outer circumferential surface pressed against a second outer circumferential surface of the endless belt to form a nip portion at which the endless belt curves along the first outer circumferential surface, the de-curling roller being configured to de-curl the sheet passing through the nip portion. The nip width adjusting mechanism adjusts the nip width by moving the de-curling roller in a direction intersecting the second outer circumferential surface of the endless belt. The belt tension adjusting mechanism adjusts the tension of the endless belt according to the nip width adjusted by the nip width adjusting mechanism.

9 Claims, 7 Drawing Sheets

(51) Int. Cl.
*B65H 43/00* (2006.01)
*B65H 29/70* (2006.01)
*G03G 15/00* (2006.01)

(52) U.S. Cl.
CPC ..... *B65H 43/00* (2013.01); *G03G 15/6576* (2013.01); *B65H 2511/13* (2013.01)

(56) References Cited

U.S. PATENT DOCUMENTS

2005/0286958 A1* 12/2005 Shiratori ..... B41J 11/0005 400/642
2011/0142518 A1* 6/2011 Nishida ..... G03G 15/6576 399/406
2012/0087706 A1* 4/2012 Dangelewicz, Jr. ..... G03G 15/6576 399/406
2016/0195835 A1* 7/2016 Toso ..... G03G 15/161 399/101
2016/0355029 A1* 12/2016 Kondo ..... B41J 2/01

* cited by examiner

DE-CURLING DEVICE AND IMAGE FORMING APPARATUS INCLUDING SAME

INCORPORATION BY REFERENCE

The application is based on Japanese Patent Application 2017-176748 filed on Sep. 14, 2017, to Japanese Patent Office, the entire contents of which is incorporated herein by reference.

BACKGROUND

The present disclosure relates to a de-curling device that de-curls a sheet on which an image is formed, and an image forming apparatus including the de-curling device.

An image forming apparatus, such as a printer, that includes a de-curling device that de-curls a sheet on which an image is formed is known.

A conventional de-curling device includes an endless belt looped around a pair of supporting rollers, a pushing roller that is pressed against an outer circumferential face of the endless belt, and a pressing force regulator that regulates the pressing force of the pushing roller applied on the endless belt. The de-curling device is configured such that the pressing force regulator moves the pushing roller to regulate the pressing force of the pushing roller applied on the endless belt, thereby changing the de-curling force applied on the sheet.

SUMMARY

A de-curling device according to one aspect of the present disclosure de-curls a sheet on which an image is formed, and includes a pair of supporting rollers, an endless belt, a de-curling roller, a nip width adjusting mechanism, and a belt tension adjusting mechanism.

The pair of supporting rollers are provided to rotate about a shaft. The endless belt is looped around the pair of supporting rollers and circulates. The de-curling roller is provided between the pair of supporting rollers and has a first outer circumferential face that is pressed against a second outer circumferential face of the endless belt to form a nip portion at which the endless belt curves along the first outer circumferential face, the de-curling roller being configured to de-curl the sheet passing through the nip portion. The nip width adjusting mechanism adjusts a nip width of the nip portion by moving the de-curling roller in a direction intersecting the second outer circumferential face of the endless belt. The belt tension adjusting mechanism adjusts a tension of the endless belt according to the nip width adjusted by the nip width adjusting mechanism.

An image forming apparatus according to another aspect of the present disclosure includes an image forming unit that forms an image on a sheet, and the above-mentioned de-curling device that de-curls a sheet on which an image is formed by the image forming unit.

DETAILED DESCRIPTION

A de-curling device and an image forming apparatus according to one embodiment of the present disclosure will be described below with reference to the drawings. Hereinafter, the directional relationship will be explained using XYZ orthogonal coordinate axes. An X direction is the right and left direction (+X is the rightward direction and −X is the leftward direction), a Y direction is the front-and-rear direction (+Y is the forward direction and −Y is the rearward direction), and a Z direction is the up-and-down direction (+Z is the upward direction and −Z is the downward direction). In the description below, a term "sheet" means a normal sheet, a cardboard, a post card, a tracing paper, and other sheet materials subjected to image forming processing.

[Overall Configuration of Image Forming Apparatus]

Figure 1:
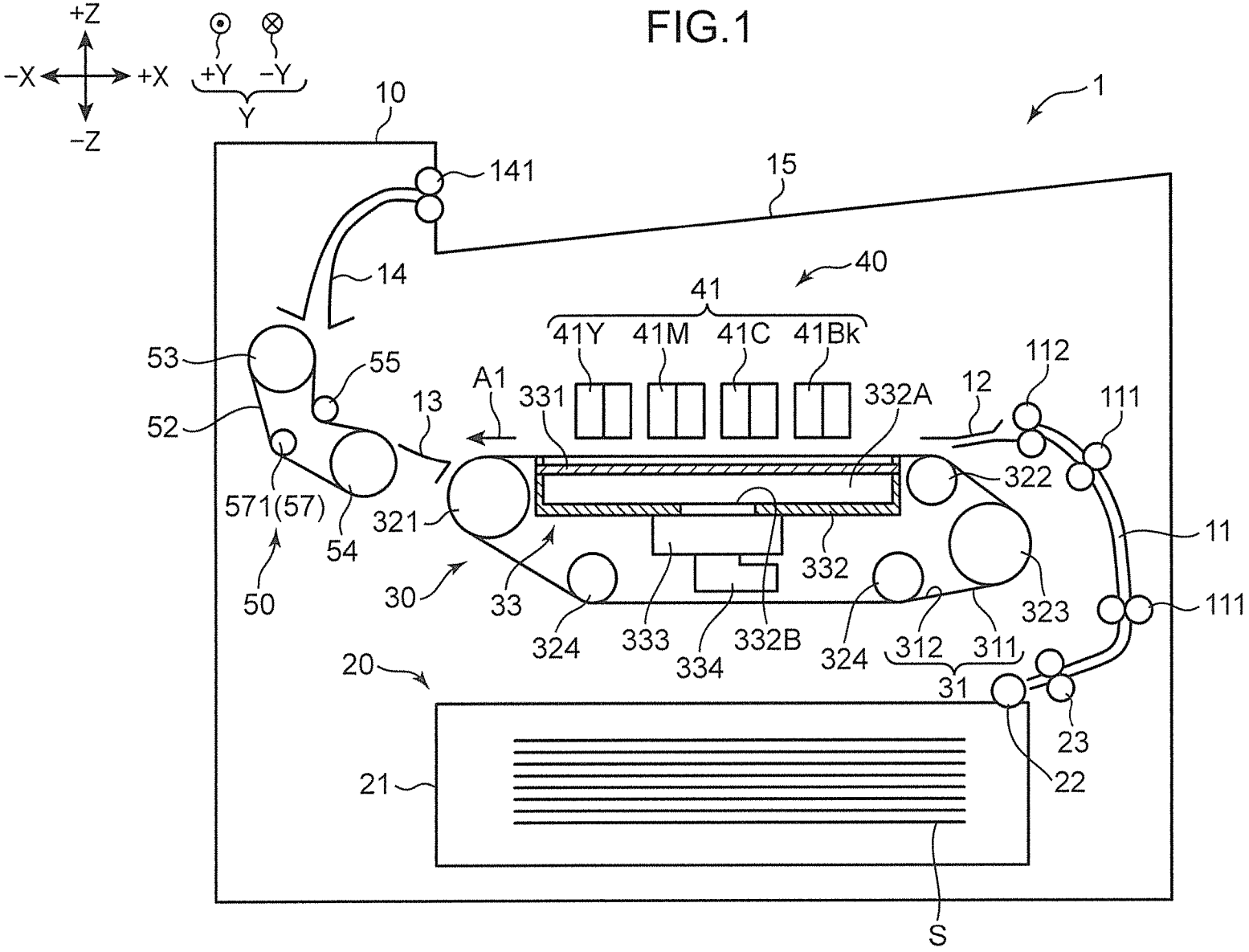
FIG. 1 illustrates an internal structure of an image forming apparatus according to one embodiment of the present disclosure.

FIG. 1 illustrates an internal structure of an image forming apparatus 1 according to one embodiment of the present disclosure. The image forming apparatus 1 illustrated in FIG. 1 is an ink jet recording apparatus that ejects ink droplets to form (record) an image on a sheet S. The image forming apparatus 1 includes an apparatus body 10, a sheet feeder 20, a sheet conveyor 30, an image forming unit 40, and a de-curling device 50.

The apparatus body 10 is a box-shaped housing that houses various components for forming an image on the sheet S. A sheet conveyance path 11 along which the sheet S is conveyed is provided in the apparatus body 10.

The sheet feeder 20 feeds the sheet S to the sheet conveyance path 11. The sheet feeder 20 includes a sheet feeding cassette 21, a pickup roller 22, and a sheet feeding roller 23. The sheet feeding cassette 21 is detachably attached to the apparatus body 10 and stores the sheet S. The pickup roller 22 is disposed at an end, in the +X side (right side) and in the +Z side (upper side), of the sheet feeding cassette 21. The pickup roller 22 picks up and feeds out the sheet S on the upper most of a stack of sheets stored in the sheet feeding cassette 21 one by one. The sheet feeding roller 23 conveys the sheet S fed out by the pickup roller 22 to a pair of resist rollers 112 disposed in the downstream end of the sheet conveyance path 11. The pair of resist rollers 112 correct skewing of the sheet S and sends the sheet S to the sheet conveyor 30 through a sheet guide 12 at a proper timing for the image forming unit 40 to perform image forming processing. A plurality of conveyance rollers 111 are disposed on the sheet conveyance path 11 and between the sheet feeding roller 23 and the pair of resist rollers 112.

The sheet guide 12 guides the sheet S sent from the pair of resist rollers 112 to an outer circumferential face 311 of a conveying belt 31 of the sheet conveyor 30.

When the leading end of the sheet S guided by the sheet guide 12 touches the outer circumferential face 311 of the conveying belt 31, the sheet S is held on the outer circumferential face 311 of the driven conveying belt 31 and conveyed in a sheet conveyance direction A1. The sheet conveyance direction A1 is a direction from the +X side (right side) to the −X side (left side) along the X direction (right and left direction).

The sheet conveyor 30 is disposed in the −Z side (lower side) of the image forming unit 40 so as to oppose a line head 41. The sheet conveyor 30 conveys the sheet S, which has been sent by the pair of resist rollers 112 and guided by the sheet guide 12, along the sheet conveyance direction A1 toward the image forming unit 40. The sheet conveyor 30 includes the conveying belt 31 and a suction unit 33.

The conveying belt 31 is an endless belt having a width in the Y direction (front-and-rear direction) and extending in the X direction (right and left direction). The conveying belt 31 is disposed so as to oppose the image forming unit 40 and conveys the sheet S on the outer circumferential face 311 in the sheet conveyance direction A1. More specifically, in a predetermined conveyance region opposing the line head 41 of the image forming unit 40, the conveying belt 31 conveys the sheet S held on the outer circumferential face 311 in the sheet conveyance direction A1.

The conveying belt 31 is stretched over a first roller 321, a second roller 322, a third roller 323, and a pair of fourth rollers 324. The suction unit 33 is disposed in the inner side of this stretched conveying belt 31 and opposes an inner circumferential face 312. The first roller 321 is a driving roller that extends in the Y direction, which is the width direction of the conveying belt 31, and is disposed in the downstream of the suction unit 33 along the sheet conveyance direction A1. The first roller 321 is driven to rotate by a driving motor (not shown) and circulates the conveying belt 31 in a predetermined direction. The sheet S held on the outer circumferential face 311 of the circulating conveying belt 31 is conveyed in the sheet conveyance direction A1.

The second roller 322 is a belt speed detecting roller extending in the Y direction and disposed in the upstream of the suction unit 33 along the sheet conveyance direction A1. The second roller 322 operates with the first roller 321. The second roller 322 is disposed so as to keep flat a region on the outer circumferential face 311 of the conveying belt 31 opposing the line head 41 and a region on the inner circumferential face 312 of the conveying belt 31 opposing the suction unit 33. A region on the outer circumferential face 311 of the conveying belt 31 opposing the line head 41 and between the first roller 321 and the second roller 322 is the predetermined conveyance region for conveying the sheet S. The second roller 322 is driven to rotate by the circulating conveying belt 31. A pulse plate (not shown) is attached to the second roller 322 and integrally rotates with the second roller 322. The rotational speed of the pulse plate is measured to detect the circulating speed of the conveying belt 31.

The third roller 323 is a tension roller that extends in the Y direction and gives a tension to the conveying belt 31 to prevent sagging of the conveying belt 31. The third roller 323 is driven to rotate by the circulating conveying belt 31. Each of the pair of fourth rollers 324 is a guide roller that extends in the Y direction and guides the conveying belt 31 so that the conveying belt 31 passes through the −Z side of the suction unit 33. The pair of fourth rollers 324 are driven to rotate by the circulating conveying belt 31.

The conveying belt 31 has a plurality of suction holes that penetrate the conveying belt 31 in the thickness direction from the outer circumferential face 311 to the inner circumferential face 312.

The suction unit 33 is disposed to oppose the image forming unit 40 with the conveying belt 31 therebetween. In more detail, the suction unit 33 is disposed in the inner side of the conveying belt 31 stretched over the first roller 321, the second roller 322, the third roller 323, and the pair of fourth rollers 324. The suction unit 33 opposes the inner circumferential face 312 of the conveying belt 31. The suction unit 33 generates a negative pressure between the sheet S, held on the outer circumferential face 311 of the conveying belt 31, and the conveying belt 31. The sheet S is thereby tightly attached to the outer circumferential face 311 of the conveying belt 31. The suction unit 33 includes a belt guiding member 331, a suction casing 332, a suction device 333, and an exhaust duct 334.

The belt guiding member 331 of the suction unit 33 is a plate member that has a width dimension approximately the same as the length of the conveying belt 31 in the width direction (Y direction). The belt guiding member 331 is disposed in a region between the first roller 321 and the second roller 322 to oppose the inner circumferential face 312 of the conveying belt 31. The belt guiding member 331 constitutes the top face of the suction casing 332 and has approximately the same shape as the suction casing 332 when viewed from the +Z side. In the region between the first roller 321 and the second roller 322, the belt guiding member 331 guides the conveying belt 31 that circulates along with the rotating first roller 321.

The belt guiding member 331 has a plurality of grooves formed in a belt guiding face that opposes the inner circumferential face 312 of the conveying belt 31. Each groove is formed so as to correspond to each suction hole of the conveying belt 31. The belt guiding member 331 is further provided with through holes that correspond to the grooves. The through hole in the groove penetrates the belt guiding member 331 in the thickness direction. The through hole communicates with the suction hole of the conveying belt 31 via the groove.

The suction unit 33 including the belt guiding member 331 configured as described above suctions air from the space in the +Z side of the conveying belt 31 through the grooves and the through the holes in the belt guiding member 331 and the suction holes in the conveying belt 31, and thereby generates a suction force. The suction force generates an airflow (suction airflow) that flows in the space above the conveying belt 31 toward the suction unit 33. When the sheet S, guided by the sheet guide 12 onto the conveying belt 31, covers a portion of the outer circumferential face 311 of the conveying belt 31, the suction force (negative force) applied to the sheet S causes the sheet S to tightly attach to the outer circumferential face 311 of the conveying belt 31.

The suction casing 332 of the suction unit 33 is a box-shaped casing that is opened to the +Z side. The suction casing 332 is disposed in the −Z side of the conveying belt 31 such that the opening of the casing opened to the +Z side is covered by the belt guiding member 331 constituting the top face of the suction casing 332. The suction casing 332 and the belt guiding member 331 constituting the top face of the suction casing 332 together define a suction space 332A. That is, the space surrounded by the suction casing 332 and the belt guiding member 331 is the suction space 332A. The suction space 332A communicates with the suction holes of the conveying belt 31 via the grooves and the through holes of the belt guiding member 331.

An opening 332B is formed in the bottom wall of the suction casing 332, and the suction device 333 is disposed at a position corresponding to the opening 332B. The exhaust duct 334 is connected to the suction device 333. The exhaust duct 334 is connected to an exhaust port (not shown) provided to the apparatus body 10.

The image forming unit 40 is disposed in the +Z side of the sheet conveyor 30. Specifically, the image forming unit 40 is disposed in the +Z side of the sheet conveyor 30 so as to oppose the outer circumferential face 311 of the conveying belt 31. The image forming unit 40 performs image forming processing on the sheet S that is held on the outer circumferential face 311 of the conveying belt 31 and conveyed in the sheet conveyance direction A1, thereby forming an image on the sheet S. In the present embodiment, the image forming unit 40 forms an image by an ink-jet method, namely, by ejecting ink droplets to the sheet S.

The image forming unit 40 includes line heads 41Bk, 41C, 41M, and 41Y. The line head 41Bk ejects black ink droplets, the line head 41C ejects cyan ink droplets, the line head 41M ejects magenta ink droplets, and the line head 41Y ejects yellow ink droplets. The line heads 41Bk, 41C, 41M, and 41Y are aligned in the sheet conveyance direction A1 from the upstream to the downstream. The line heads 41Bk, 41C, 41M, and 41Y have the same configuration except that they eject ink droplets of different colors, and may collectively be referred to as a line head 41.

The line head 41 forms an image on the sheet S by ejecting ink droplets to the sheet S, which is held on the outer circumferential face 311 of the conveying belt 31 and conveyed in the sheet conveyance direction A1. In more detail, the line head 41 ejects ink droplets to the sheet S conveyed by the conveying belt 31 passing through the space in front of the line head 41. The image is thereby formed on the sheet S.

The sheet S, on which an image is formed by the line head 41 ejecting ink droplets, is conveyed by the conveying belt 31 and guided by a sheet sending guide 13 to be sent to the de-curling device 50. The de-curling device 50 is disposed in the downstream of the sheet sending guide 13 along the sheet conveyance direction A1 of the conveying belt 31. The de-curling device 50 conveys the sheet S, on which an image is formed, to the downstream and de-curls the sheet S. The details on the de-curling device 50 will be described later.

The sheet S de-curled by the de-curling device 50 passes through a discharge conveyance path 14 provided in the downstream of the de-curling device 50 in the apparatus body 10 and then ejected by a pair of sheet ejection rollers 141, provided in the downstream end of the discharge conveyance path 14, onto a sheet ejection tray 15 provided on the top face of the apparatus body 10.

More water-based inks have popularly been used for the image forming apparatus 1 using the ink-jet method. When the paper sheet S absorbs water, hydrogen bonds of cellulose of the sheet S break and the sheet S swells. This causes the sheet S to curl (bend) in such a direction that the face that have caught the ink (the face on which an image is formed) is convex. Therefore, the image forming apparatus 1 includes the de-curling device 50 for de-curling the sheet S.

[Configuration of De-Curling Device]

First Embodiment

Figure 2:
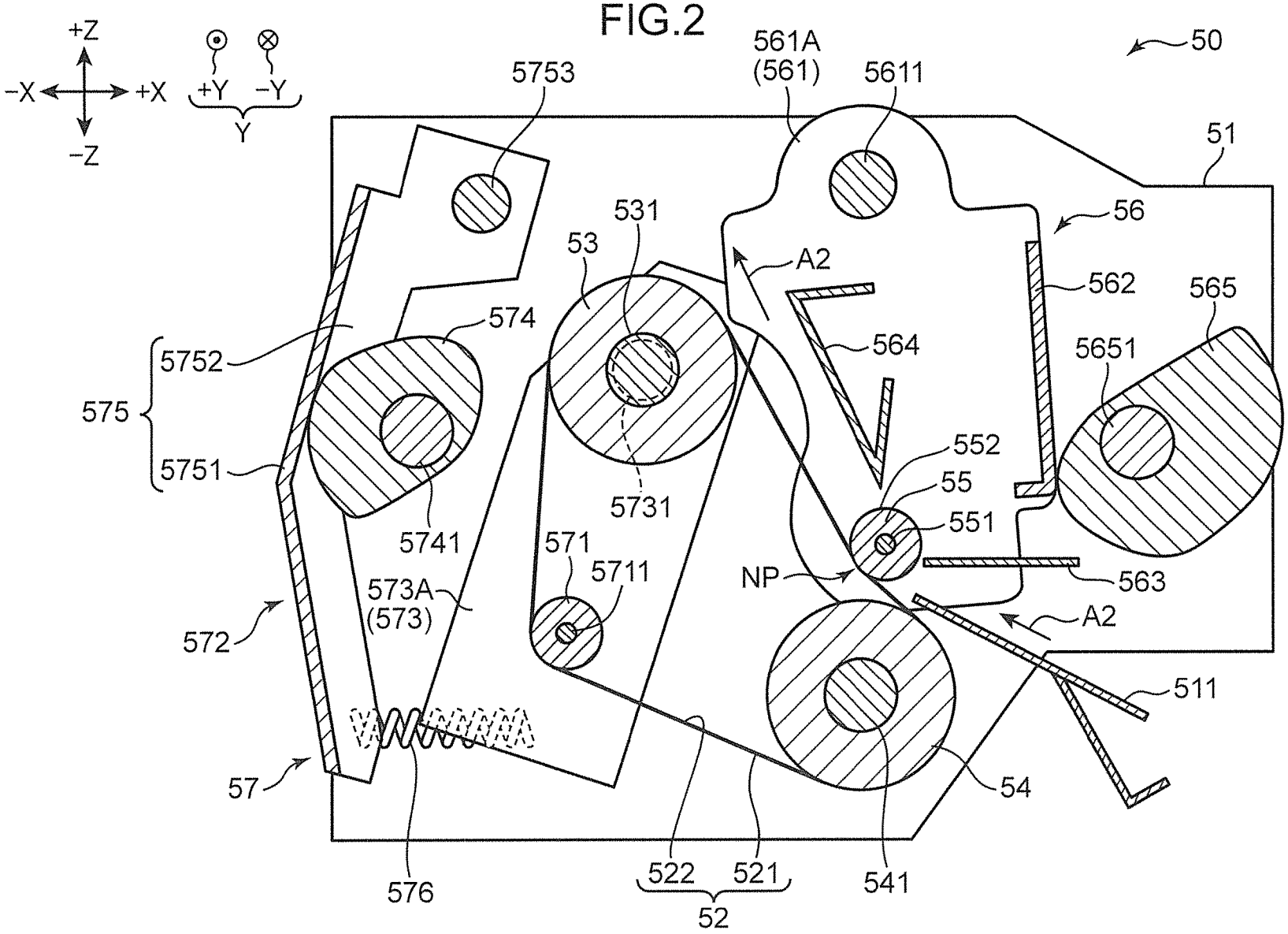
FIG. 2 is a sectional view of a de-curling device according to first embodiment provided in the image forming apparatus.
Figure 3:
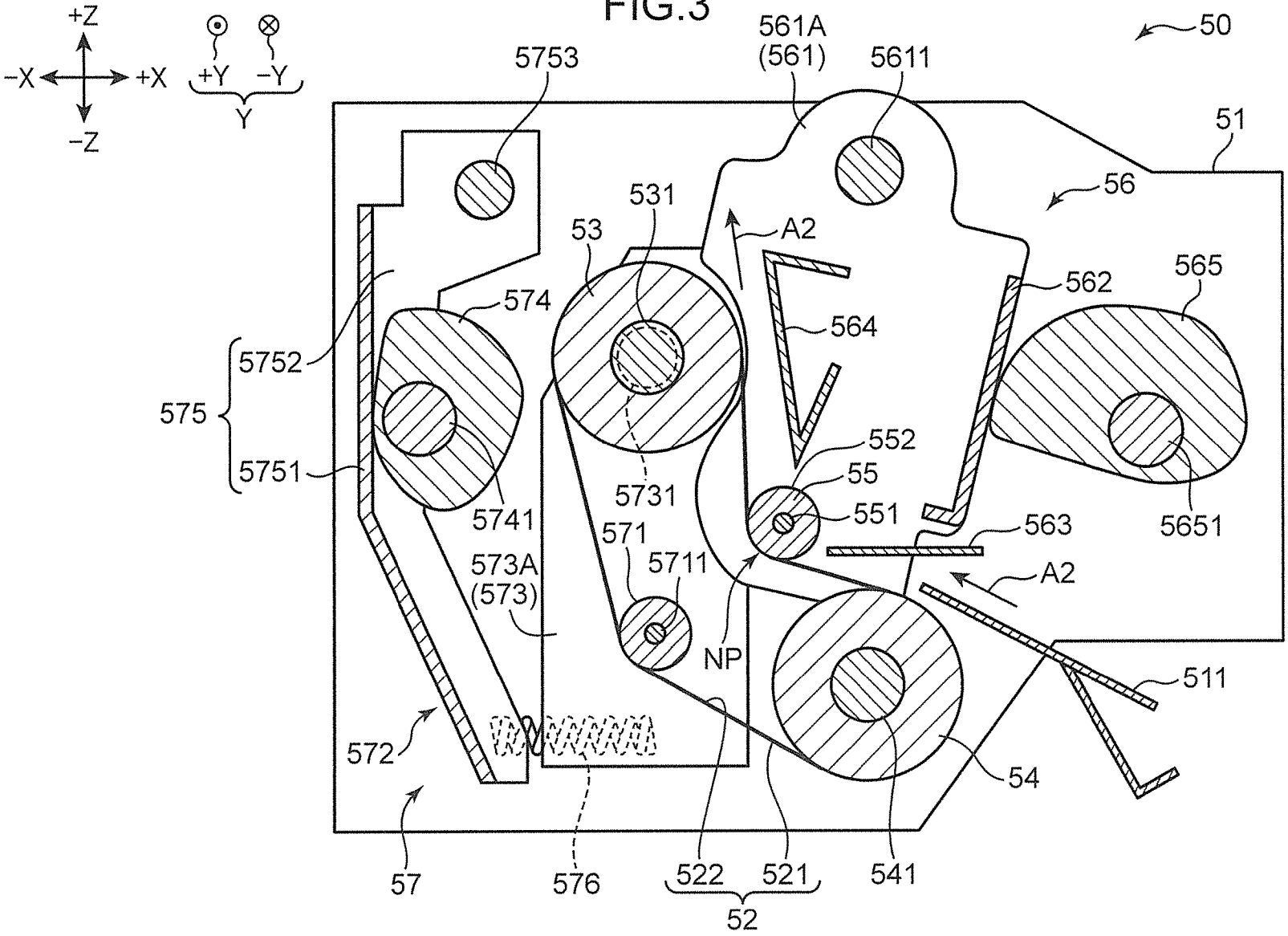
FIG. 3 is a sectional view of the de-curling device according to the first embodiment.
Figure 4:
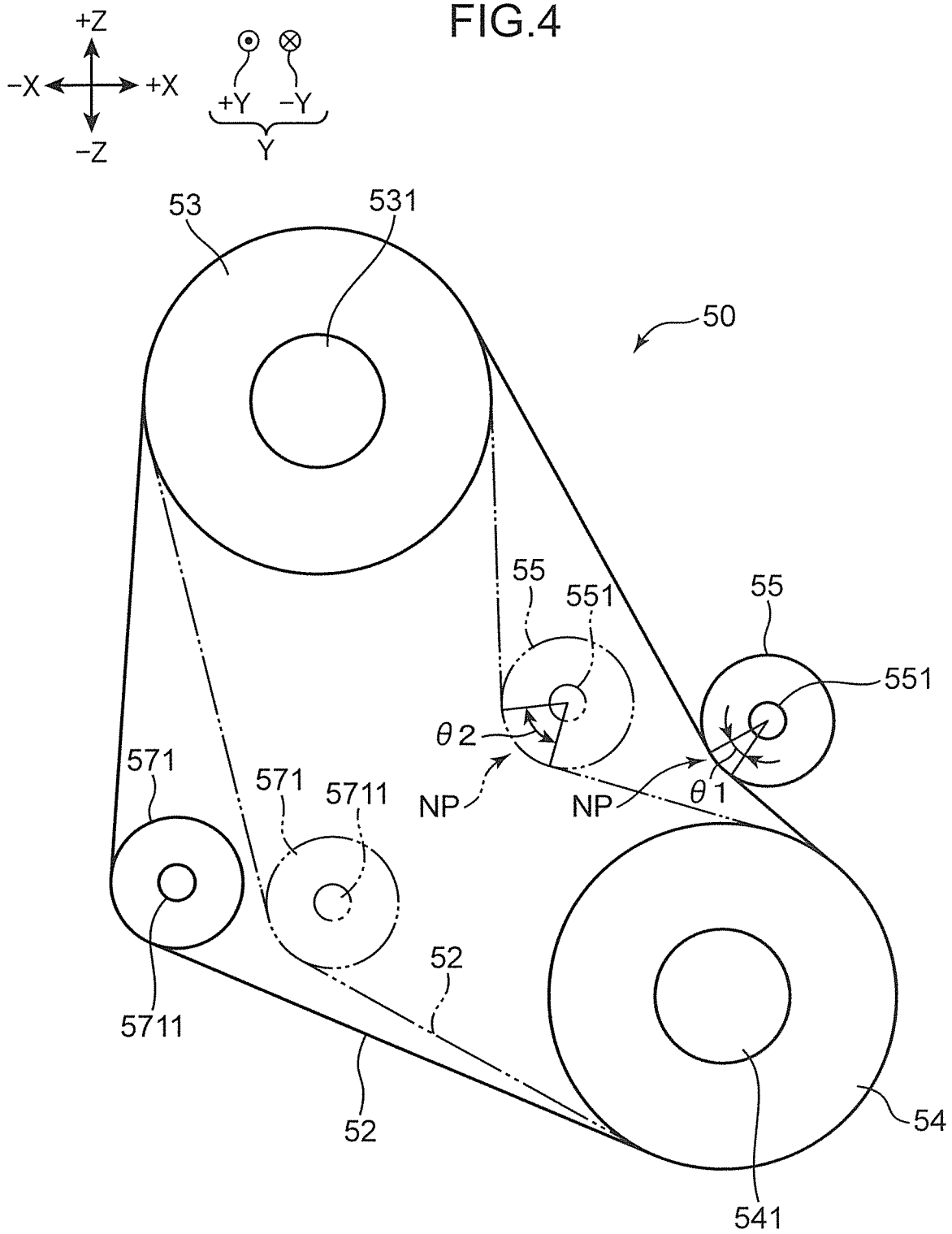
FIG. 4 is a diagram for explaining an operation of the de-curling device according to the first embodiment.

FIGS. 2 and 3 are sectional views of a de-curling device 50 according to first embodiment provided in an image forming apparatus 1. FIG. 4 is a diagram for explaining an operation of the de-curling device 50 according to the first embodiment. The de-curling device 50 includes a main frame 51, an endless belt 52, a de-curling roller 55, a nip width adjusting mechanism 56, and a belt tension adjusting mechanism 57.

The main frame 51 is a frame for supporting members that constitute the de-curling device 50 and is fixed between a sheet sending guide 13 and a discharge conveyance path 14 in the apparatus body 10. A sheet guiding plate 511 is provided on the end in the +X side and in the −Z side of the main frame 51. The sheet S guided by the sheet sending guide 13 and sent out from the conveying belt 31 is handed over from the sheet guiding plate 511 to the de-curling device 50. The sheet guiding plate 511 guides the sheet S to the endless belt 52.

The endless belt 52 is a belt having a width in the Y direction. The endless belt 52 is stretched over a pair of supporting rollers, i.e., a first supporting roller 53 and a second supporting roller 54 rotatably provided about each axis. The first supporting roller 53 is a driving roller extending in the Y direction, which is the width direction of the endless belt 52, and supported by the main frame 51. The first supporting roller 53 is driven by a driving motor (not shown) to rotate about a rotating shaft 531, thereby circulating the endless belt 52. Along with the circulation of the endless belt 52, the sheet S is conveyed in a sheet conveyance direction A2 along an outer circumferential face 521 (second outer circumferential face) of the endless belt 52. The second supporting roller 54 is a driven roller extending in the Y direction and rotatably supported by the main frame 51. The second supporting roller 54 is driven by the circulating endless belt 52 to rotate about a rotating shaft 541. The second supporting roller 54 is disposed diagonally lower than the first supporting roller 53 in the +X side and is located near the sheet guiding plate 511.

A region, on the outer circumferential face 521 of the endless belt 52, which opposes a de-curling roller 55, to be described later, and between the first supporting roller 53 and the second supporting roller 54 is a conveyance region for conveying the sheet S. That is, the first supporting roller 53 defines the downstream end along the sheet conveyance direction A2 in the de-curling device 50, and the second supporting roller 54 defines the upstream end along the sheet conveyance direction A2 in the de-curling device 50.

The de-curling roller 55 extends in the Y direction and is rotatably supported by a roller supporting holder 561, to be described later, of the nip width adjusting mechanism 56. The de-curling roller 55 is disposed between the first supporting roller 53 and the second supporting roller 54. The de-curling roller 55 has an outer circumferential face 552 (first outer circumferential face) that is pressed against an outer circumferential face 521 of the endless belt 52 and is driven by the circulating endless belt 52 to rotate about a rotating shaft 551.

The endless belt 52 and the de-curling roller 55 form therebetween a nip portion NP through which the sheet S passes. The nip portion NP curves along the outer circumferential face 552 of the de-curling roller 55. In other words, the curvature radius of the curved nip portion NP is identical to the radius of the de-curling roller 55. The sheet S, on which an image is formed, is conveyed by the circulating endless belt 52 in the sheet conveyance direction A2 and passes through the curved nip portion NP, thereby de-curled.

The nip width adjusting mechanism 56 adjusts the nip width of the nip portion NP by moving the de-curling roller 55 in an approaching direction or a separating direction with respect to the outer circumferential face 521 of the endless belt 52, that is, the direction intersecting the axial direction (Y direction) of the rotating shaft 551. The nip width of the nip portion NP is the width in the direction through which the sheet S passes (sheet conveyance direction A2), the direction being perpendicular to the axial direction. The nip width of the nip portion NP is the width along the circumferential direction of the outer circumferential face 552 of the de-curling roller 55.

The nip width adjusting mechanism 56 moves the de-curling roller 55 to adjust the nip width of the nip portion NP within the range from a standard first nip width to a second nip width wider than the first nip width. Solid lines in FIGS. 2 and 4 illustrate the de-curling roller 55 moved to a position where the nip width of the nip portion NP is set to the standard first nip width. The two-dot chain lines in FIG. 4 illustrate the de-curling roller 55 moved to a position where the nip width of the nip portion NP is set to the second nip width. Regarding the winding angle of the endless belt 52 around the de-curling roller 55 at the nip portion NP, as illustrated in FIG. 4, a winding angle θ2 corresponding to the second nip width wider than the first nip width is larger than a winding angle θ1 corresponding to the standard first nip width.

The nip width adjusting mechanism 56 is configured to adjust the nip width of the nip portion NP. The de-curling force applied on the sheet S passing through the nip portion NP can thereby be adjusted. The de-curling force applied on the sheet S passing through the nip portion NP is greater for a wider nip portion NP. That is, the de-curling force applied on the sheet S passing through the nip portion NP is greater when the nip width of the nip portion NP is set to the second nip width (as illustrated by two-dot chain lines in FIG. 4) by moving the de-curling roller 55 by the nip width adjusting mechanism 56 than when the nip width of the nip portion NP is set to the standard first nip width (as illustrated by solid lines in FIGS. 2 and 4). When the degree of the curl (curvature) of the sheet S, on which an image is formed, is greater than a nominal curl, the nip width of the nip portion NP may be changed to the second nip width wider than the standard first nip width. In this manner, a further greater de-curling force can be applied on the sheet S, which has been curled by a large degree, when the sheet S passes through the nip portion NP. Thus, the sheet S that has curled by image forming can suitably be de-curled.

The nip width adjusting mechanism 56 is specifically configured as follows. The nip width adjusting mechanism 56 includes a first roller supporting holder 561 that rotatably supports the de-curling roller 55, and a nip width adjusting cam 565.

The first roller supporting holder 561 is formed of a pair of first supporting plates 561A disposed to face each other with a gap therebetween in the width direction (Y direction). The de-curling roller 55 is supported between the pair of first supporting plates 561A. In FIGS. 2 and 3, only one of the pair of first supporting plates 561A is illustrated and the other first supporting plate is omitted. The first roller supporting holder 561 is supported by the main frame 51 so as to be rotatable about a rotating shaft 5611 provided to penetrate the pair of first supporting plates 561A.

A cam contact portion 562 is provided to each of the pair of first supporting plates 561A. That is, the cam contact portions 562 are provided on both ends, in the width direction, of the first roller supporting holder 561. The cam contact portions 562 are provided on the +X side ends of the pair of first supporting plates 561A, and the nip width adjusting cam 565 makes contact with the cam contact portions 562.

A first sheet guide 563 and a second sheet guide 564 are provided between the pair of first supporting plates 561A to extend throughout the width direction. The first sheet guide 563 is provided on the −Z side end of the pair of first supporting plates 561A so as to oppose the sheet guiding plate 511 of the main frame 51. The first sheet guide 563 guides the sheet S, guided by the sheet guiding plate 511 and supplied to the endless belt 52, to the nip portion NP. The second sheet guide 564 is provided on the −X side end of the pair of first supporting plates 561A so as to oppose the first supporting roller 53 with the endless belt 52 therebetween. The second sheet guide 564 guides the sheet S, which has passed through the nip portion NP, to be conveyed by the circulating endless belt 52.

The nip width adjusting cam 565 is a cam member supported by the main frame 51 so as to be rotatable about a cam rotating shaft 5651. A pair of nip width adjusting cams 565 are provided in positions corresponding to the cam contact portions 562 disposed on both ends, in the width direction, of the first roller supporting holder 561. The nip width adjusting cam 565 rotates about the cam rotating shaft 5651 while making contact with the cam contact portion 562. In the nip width adjusting mechanism 56, the first roller supporting holder 561 rotates about the rotating shaft 5611 along with the rotating nip width adjusting cam 565. When the first roller supporting holder 561 rotates, the de-curling roller 55 supported by the first roller supporting holder 561 moves toward the endless belt 52. The nip width of the nip portion NP thereby adjusts. The de-curling roller 55 moves along the arc of which center is on the axis of the rotating shaft 5611 of the first roller supporting holder 561.

Then, the belt tension adjusting mechanism 57 adjusts the tension of the endless belt 52 according to the nip width adjusted by the nip width adjusting mechanism 56. By adjusting the tension of the endless belt 52, the conveyance force applied on the sheet S passing through the nip portion NP is adjusted according to the change in the nip width and kept constant. Thus, the sheet S is suitably conveyed to pass through the nip portion NP.

In the present embodiment, the belt tension adjusting mechanism 57 reduces the tension of the endless belt 52 in proportion to the nip width of the nip portion NP. In more detail, the belt tension adjusting mechanism 57 adjusts the tension of the endless belt 52 such that a second tension corresponding to the state where the nip width of the nip portion NP is set to the second nip width wider than the first nip width (as illustrated in two-dot chain lines in FIG. 4) is smaller than a first tension corresponding to the state where the nip width of the nip portion NP is set to the standard first nip width (as illustrated in solid lines in FIGS. 2 and 4), the nip width of the nip portion NP being regulated by the nip width adjusting mechanism 56. In this manner, the conveyance force applied on the sheet S passing through the nip portion NP is adjusted according to the nip width adjusting within the range from the first nip width to the second nip width and kept constant. Thus, the de-curling force applied on the sheet S can be adjusted according to the change in the nip width while the sheet S is suitably conveyed to pass through the nip portion NP.

The belt tension adjusting mechanism 57 of the present embodiment is specifically configured as below. The belt tension adjusting mechanism 57 includes a tension roller 571 and a first roller moving mechanism 572.

The tension roller 571 is a roller provided on an inner circumferential face 522 side of the endless belt 52. The tension roller 571 applies a tension to the endless belt 52 while allowing the endless belt 52 to circulate. The tension roller 571 extends along the Y direction and is rotatably supported by a second roller supporting holder 573 of the first roller moving mechanism 572 to be described later. The tension roller 571 is driven by the circulating endless belt 52 to rotate about a rotating shaft 5711.

The first roller moving mechanism 572 moves the tension roller 571 in a direction intersecting the inner circumferential face 522 of the endless belt 52 (axial direction of the rotating shaft 5711, namely, Y direction) to adjust the tension of the endless belt 52. The first roller moving mechanism 572 moves the tension roller 571 without changing the positions of the first supporting roller 53 and the second supporting roller 54 that support the endless belt 52. As described above, the first supporting roller 53 defines the downstream end along the sheet conveyance direction A2 in the de-curling device 50, and the second supporting roller 54 defines the upstream end along the sheet conveyance direction A2 in the de-curling device 50. The first roller moving mechanism 572 moves the tension roller 571 without changing the positions of the first supporting roller 53 and the second supporting roller 54. Thus, the upstream end and the downstream end along the sheet conveyance direction A2 in the de-curling device 50 can be set in fixed positions.

The first roller moving mechanism 572 is specifically configured as below. The first roller moving mechanism 572 includes the second roller supporting holder 573 that supports the tension roller 571, a belt tension adjusting cam 574, a cam contact member 575, and a connecting spring member 576.

The second roller supporting holder 573 is formed of a pair of second supporting plates 573A disposed to oppose each other with a gap therebetween along the width direction. The tension roller 571 is supported between the pair of second supporting plates 573A. The pair of second supporting plates 573A constituting the second roller supporting holder 573 are disposed further in the outer side, in the width direction, than the pair of first supporting plates 561A constituting the first roller supporting holder 561 and further in the outer side than the first supporting roller 53. In FIGS. 2 and 3, only one of the pair of second supporting plates 573A is illustrated, and the other second supporting plate is omitted.

The second roller supporting holder 573 is supported by the main frame 51 so as to be rotatable about a rotating shaft 5731 provided so as to penetrate the pair of second supporting plates 573A. The rotating shaft 5731 of the second roller supporting holder 573 and the rotating shaft 531 of the first supporting roller 53 are coaxially provided.

The cam contact member 575 makes contact with the belt tension adjusting cam 574. The cam contact member 575 is provided in the −X side of the second roller supporting holder 573 and supported by the main frame 51 so as to be rotatable about a rotating shaft 5753. The cam contact member 575 includes a cam contact portion 5751 having a plate shape extending in the width direction, and a pair of extended portions 5752 that extend in the +X side from both edge, in the width direction, of the cam contact portion 5751. The cam contact portion 5751 makes contact with the belt tension adjusting cam 574. The pair of extended portions 5752 are provided with the rotating shaft 5753 penetrating therethrough. The pair of extended portions 5752 of the cam contact member 575 and the pair of second supporting plates 573A of the second roller supporting holder 573 are connected by the connecting spring member 576. That is, the cam contact member 575 and the second roller supporting holder 573 are connected by the connecting spring member 576.

The belt tension adjusting cam 574 is a cam member supported by the main frame 51 so as to be rotatable about a cam rotating shaft 5741. The belt tension adjusting cam 574 is positioned to face the middle portion, in the width direction, of the cam contact portion 5751 of the cam contact member 575. Alternatively, a pair of belt tension adjusting cams 574 are positioned to face both sides, in the width direction, of the cam contact portion 5751 of the cam contact member 575. The belt tension adjusting cam 574 rotates about the cam rotating shaft 5741 while making contact with the cam contact portion 5751 of the cam contact member 575. The cam contact member 575 rotates about the rotating shaft 5753 along with the rotating belt tension adjusting cam 574. When the rotating cam contact member 575 rotates, the second roller supporting holder 573, which is connected to the cam contact member 575 via the connecting spring member 576, rotates about the rotating shaft 5731. The rotating second roller supporting holder 573 moves the tension roller 571 supported by the second roller supporting holder 573. The tension of the endless belt 52 is thereby adjusted.

Second Embodiment

Figure 5:
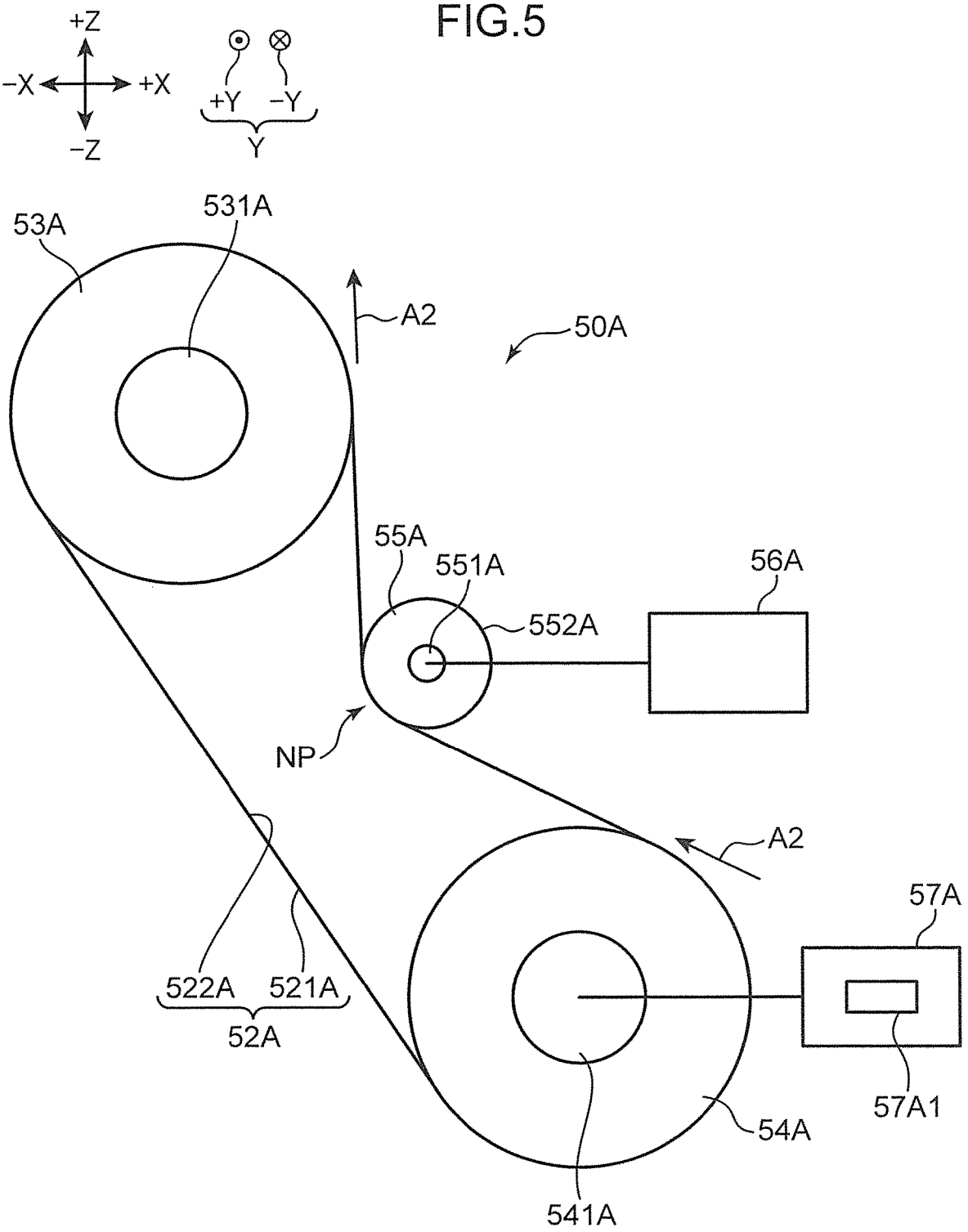
FIG. 5 illustrates a de-curling device according to second embodiment.
Figure 6:
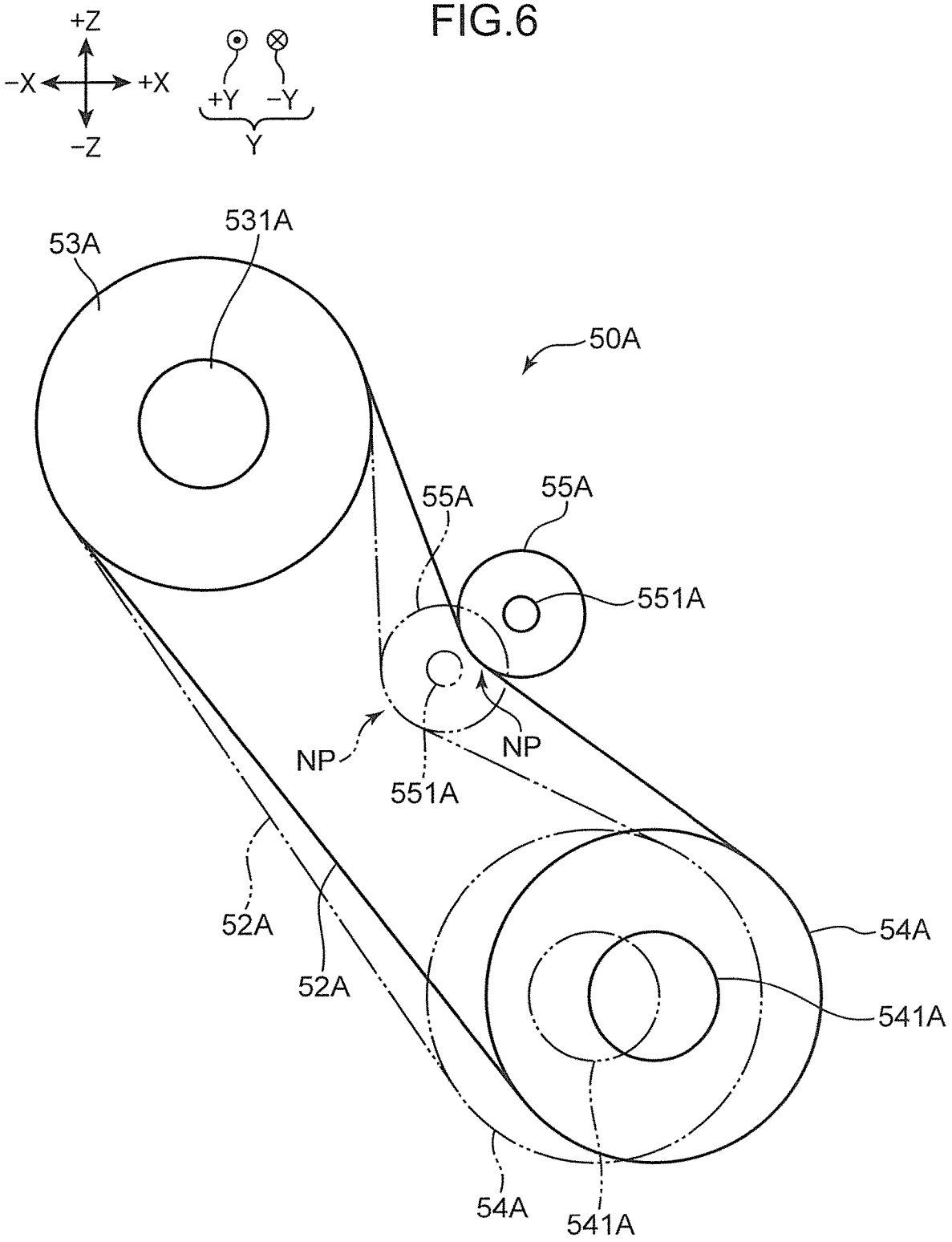
FIG. 6 is a diagram for explaining an operation of the de-curling device according to the second embodiment.

FIG. 5 illustrates a de-curling device 50A according to second embodiment. FIG. 6 is a diagram for explaining an operation of the de-curling device 50A according to the second embodiment. The de-curling device 50A according to the second embodiment differs from the de-curling device 50 according to the first embodiment in the configuration of a nip width adjusting mechanism 56A and a belt tension adjusting mechanism 57A. The de-curling device 50A according to the second embodiment is configured similarly to the de-curling device 50 according to the first embodiment except the configuration of the nip width adjusting mechanism 56A and the belt tension adjusting mechanism 57A.

Similar to the de-curling device 50 described above, the de-curling device 50A includes an endless belt 52A, a de-curling roller 55A, a nip width adjusting mechanism 56A, and a belt tension adjusting mechanism 57A.

The endless belt 52A has a width in the Y direction and is looped around a pair of supporting rollers, i.e., a first supporting roller 53A and a second supporting roller 54A. The first supporting roller 53A is a driving roller extending in the Y direction, which is the width direction of the endless belt 52A. The first supporting roller 53A is driven to rotate about the rotating shaft 531A to circulate the endless belt 52A. The sheet S is conveyed in the sheet conveyance direction A2 along an outer circumferential surface 521A of the circulating endless belt 52A. The second supporting roller 54A is a driven roller extending along the Y direction. The second supporting roller 54A is driven by the circulating endless belt 52A to rotate about the rotating shaft 541A. The first supporting roller 53A defines the downstream end along the sheet conveyance direction A2 in the de-curling device 50A, and the second supporting roller 54A defines the upstream end along the sheet conveyance direction A2 in the de-curling device 50A.

The de-curling roller 55A extends along the Y direction and is disposed between the first supporting roller 53A and the second supporting roller 54A. The de-curling roller 55A has an outer circumferential surface 552A (second outer circumferential surface) that is pressed against the outer circumferential surface 521A (first outer circumferential surface) of the endless belt 52A. The de-curling roller 55A is driven by the circulating endless belt 52A to rotate about the rotating shaft 551A. The nip portion NP through which the sheet S passes is formed between the endless belt 52A and the de-curling roller 55A. The nip portion NP is curved along the outer circumferential surface 552A of the de-curling roller 55A. The sheet S on which an image is formed is conveyed in the sheet conveyance direction A2 by the circulating endless belt 52A, passes through the curved nip portion NP, and is thereby curled.

The nip width adjusting mechanism 56A adjusts the nip width of the nip portion NP by moving the de-curling roller 55A in an approaching direction or a separating direction with respect to the outer circumferential face 521A of the endless belt 52A, namely, in a direction intersecting the axial direction of the rotating shaft 551A. In the de-curling device 50 according to the first embodiment described above, the nip width adjusting mechanism 56 moves the de-curling roller 55 along the arc of which center is on the axis of the rotating shaft 5611 of the first roller supporting holder 561. In contrast, the nip width adjusting mechanism 56A moves the de-curling roller 55A linearly as illustrated in FIG. 6. The de-curling roller 55A is rotatably supported by shaft supporting portions each having a form of a linearly extending elongate hole. For example, the nip width adjusting mechanism 56A includes a spring member and moves the de-curling roller 55A linearly along the shaft supporting portions, each having a form of an elongate hole.

The nip width adjusting mechanism 56A moves the de-curling roller 55A to adjust the nip width of the nip portion NP within the range from the standard first nip width to the second nip width wider than the first nip width. In FIG. 6, the de-curling roller 55A moved so as to set the nip width of the nip portion NP to the standard first nip is illustrated in solid lines. In FIG. 6, the de-curling roller 55A moved so as to set the nip width of the nip portion NP to the second nip width is illustrated in two-dot chain lines. The nip width adjusting mechanism 56A is configured to adjust the nip width of the nip portion NP. The de-curling force applied on the sheet S passing through the nip portion NP is thereby adjusted.

The belt tension adjusting mechanism 57A adjusts the tension of the endless belt 52A according to the nip width adjusted by the nip width adjusting mechanism 56A. The conveyance force applied on the sheet S passing through the nip portion NP is adjusted according to the change in the nip width by adjusting the tension of the endless belt 52A and is kept constant. The sheet S passing through the nip portion NP is thereby suitably conveyed.

The belt tension adjusting mechanism 57A reduces the tension of the endless belt 52 in proportion to the nip width of the nip portion NP. In more detail, the belt tension adjusting mechanism 57A adjusts the tension of the endless belt 52A such that the second tension corresponding to the state where the nip width of the nip portion NP is set to the second nip width wider than the first nip width (as illustrated in two-dot lines in FIG. 6) is smaller than the first tension corresponding to the state where the nip width of the nip portion NP is set to the standard first nip width (as illustrated in solid lines in FIG. 6), the nip width of the nip portion NP being adjusted by the nip width adjusting mechanism 56A. In this manner, the conveyance force applied on the sheet S passing through the nip portion NP is adjusted according to the nip width adjusted within the range from the first nip width to the second nip width and kept constant.

The belt tension adjusting mechanism 57A includes a second roller moving mechanism 57A1. The second roller moving mechanism 57A1 changes the tension of the endless belt 52A by moving at least one of the first supporting roller 53A and the second supporting roller 54A that support the endless belt 52A, the movement being made in a direction intersecting the axial direction (Y direction). In the present embodiment, the second roller moving mechanism 57A1 moves the second supporting roller 54A, which is a driven roller and is the one among the first supporting roller 53A and the second supporting roller 54A that set up the endless belt 52A, in a direction intersecting the axial direction of the rotating shaft 541A. The second supporting roller 54A is rotatably supported by the shaft supporting portions each having a form of a linearly extending elongate hole. For example, the second roller moving mechanism 57A1 includes a spring member and moves the second supporting roller 54A in the direction along the shaft supporting portions each having a form of an elongate hole.

In the de-curling device 50A of the present embodiment, the endless belt 52A is stretched over only two supporting rollers, i.e., the first supporting roller 53A and the second supporting roller 54A. Thus, it can be said that the de-curling device 50A has a simple configuration compared to the de-curling device 50 in which the endless belt is stretched over three rollers including two supporting rollers and a tension roller. Even with this simple configuration, the de-curling force applied on the sheet S passing through the nip portion NP can be changed while suitably conveying the sheet S using the belt tension adjusting mechanism 57A that adjusts the tension of the endless belt 52A and the nip width adjusting mechanism 56A that adjusts the nip width of the nip portion NP.

[Operation of De-Curling Device]

The de-curling devices 50 and 50A are each configured to change the de-curling force applied on the sheet S corresponding to the information including the thickness of the sheet S (sheet thickness, basis weight), and an image area ratio which is the area ratio of the image to the sheet S. The image area ratio of the sheet S is determined by the image data referred to when the line head 41 of the image forming unit 40 ejects ink to the sheet S.

Figure 7:
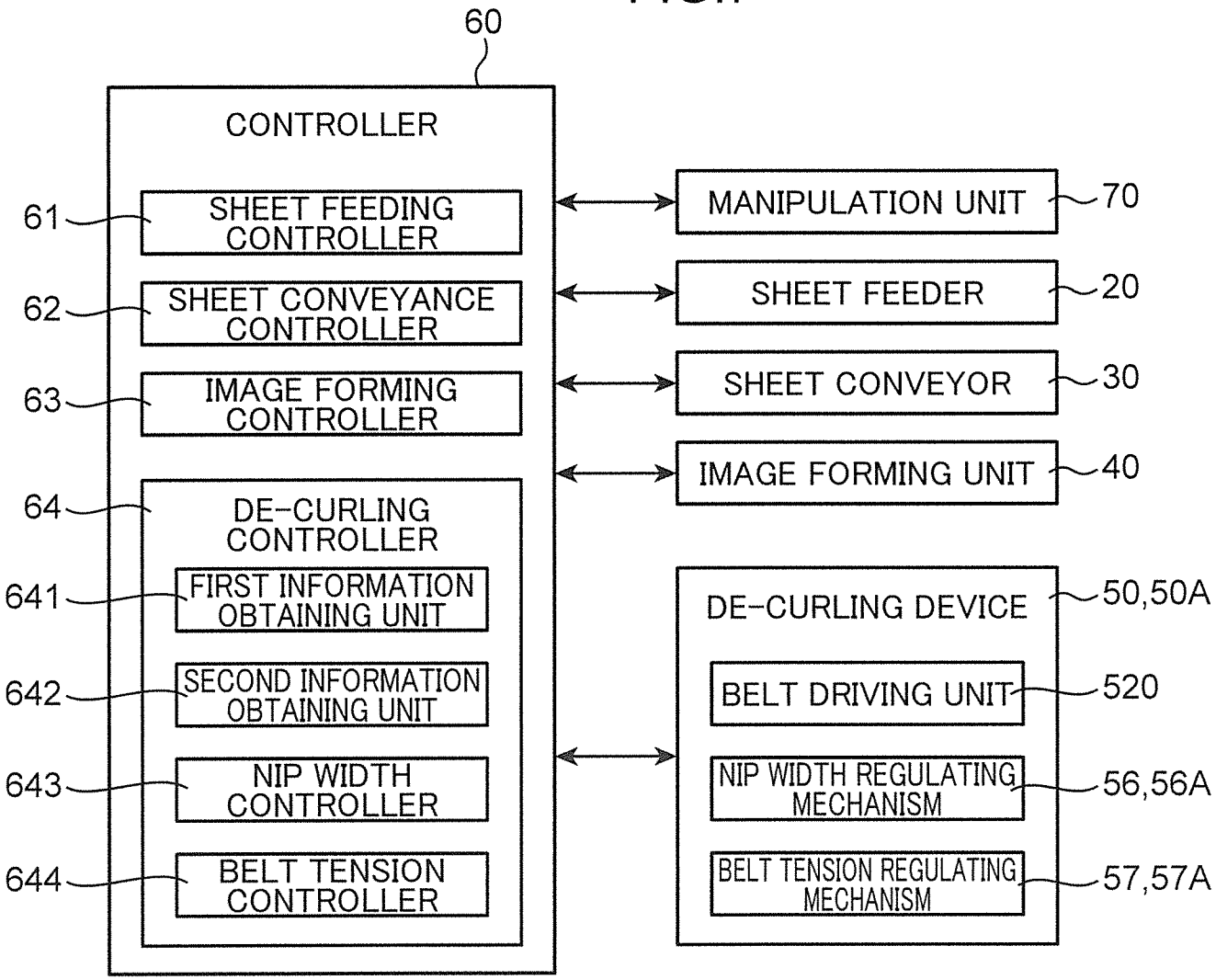
FIG. 7 is a block diagram illustrating a control system of the image forming apparatus.

With operations of the image forming apparatus 1, operations of the de-curling devices 50 and 50A capable of changing the de-curling force within the range from the force applied on the normal sheet (hereinafter referred to as "first sheet S1") having the standard first sheet thickness (basis weight) to the force applied on the cardboard (hereinafter referred to as "second sheet S2") having the second sheet thickness (basis weight) larger than the first sheet thickness will be described with reference to the block diagram shown in FIG. 7.

The image forming apparatus 1 includes a controller 60 and a manipulation unit 70. The manipulation unit 70 includes a touch panel, a ten key, a start key, and a setting key. A user manipulates and sets settings of the image forming apparatus 1 through the manipulation unit 70. The information input to the manipulation unit 70 includes information on the thickness of the sheet S.

The controller 60 includes a central processing unit (CPU), a read only memory (ROM) that stores a control program, and a random access memory (RAM) used as a work space for the CPU. The controller 60 integrally manages operations of the image forming apparatus 1 by the CPU executing the control program stored in the ROM. As illustrated in FIG. 7, the controller 60 includes a sheet feeding controller 61, a sheet conveyance controller 62, an image forming controller 63, and a de-curling controller 64.

The sheet feeding controller 61 controls a feeding operation performed by the sheet feeder 20. The sheet conveyance controller 62 controls a sheet conveyance operation performed by the sheet conveyor 30. The image forming controller 63 controls an image forming operation performed by the image forming unit 40 such that the area ratio of an image formed on the sheet S becomes the image area ratio corresponding to the image data.

The de-curling controller 64 constitutes a portion of the de-curling device 50 or 50A and controls an operation of the de-curling device 50 or 50A. The de-curling controller 64 controls circulation of the endless belt 52 or 52A performed by a belt driving unit 520, an operation of adjusting the nip width performed by the nip width adjusting mechanism 56 or 56A, and an operation of adjusting the belt tension performed by the belt tension adjusting mechanism 57 or 57A. The de-curling controller 64 includes a first information obtaining unit 641, a second information obtaining unit 642, a nip width controller 643, and a belt tension controller 644.

The first information obtaining unit 641 obtains sheet thickness information which is related to the thickness of the sheet S and has been input to the manipulation unit 70. The second information obtaining unit 642 obtains from the image forming unit 40 the image area ratio information related to the image area ratio corresponding to the image data of the sheet S.

Based on the sheet thickness information obtained by the first information obtaining unit 641 and the image area ratio information obtained by the second information obtaining unit 642, the nip width controller 643 controls the movement of the de-curling roller 55 or 55A to control the operation of adjusting the nip width performed by the nip width adjusting mechanism 56 or 56A.

The degree of curl (curvature) of the sheet S generated by forming an image depends on the sheet thickness. The degree of curl of the sheet S is smaller as the sheet thickness is larger. For the sheet S having a large sheet thickness, application of an excessively large de-curling force may curl the sheet S in a direction opposite to the curl direction caused by forming an image. Thus, the nip width controller 643 controls the movement of the de-curling roller 55 or 55A according to the sheet thickness information obtained by the first information obtaining unit 641, thereby controlling the operation of adjusting the nip width performed by the nip width adjusting mechanism 56 or 56A to adjust the de-curling force applied on the sheet S passing through the nip portion NP.

If the sheet thickness information obtained by the first information obtaining unit 641 represents the second sheet thickness larger than the first standard first sheet thickness, namely, the second sheet S2 (cardboard), the nip width adjusting mechanism 56 or 56A, controlled by the nip width controller 643, moves the de-curling roller 55 or 55A so that the nip width of the nip portion NP becomes the first nip width narrower than the second nip width, which can apply a greater de-curling force. In this manner, a suitable de-curling force can be applied on the second sheet S2 having the second sheet thickness. Thus, the second sheet S2 curled by forming an image can suitably be de-curled.

The degree of curl generated on the sheet S depends on the area ratio of an image formed on the sheet S. The degree of curl of the sheet S is greater as an image area ratio is higher. The image area ratio is less likely to affect the degree of curl of the second sheet S2 having the second sheet thickness. On the other hand, the degree of curl of the first sheet S1 having the standard first sheet thickness (normal sheet) is likely to be affected by the image area ratio. In this respect, if the sheet thickness information obtained by the first information obtaining unit 641 represents the first sheet thickness, namely, the first sheet S1, the nip width controller 643 controls the movement of the de-curling roller 55 or 55A according to the image area ratio information obtained by the second information obtaining unit 642. In this manner, the operation of adjusting the nip width performed by the nip width adjusting mechanism 56 or 56A is controlled and the de-curling force applied on the first sheet S1 passing through the nip portion NP is adjusted.

When the image area ratio information representing the first image area ratio which is equal to or smaller than a predetermined area ratio is obtained by the second information obtaining unit 642, the nip width adjusting mechanism 56 or 56A moves the de-curling roller 55 or 55A to set the nip width of the nip portion NP to the first nip width. On the other hand, when the image area ratio information representing the second image area ratio which is higher than the predetermined area ratio is obtained by the second information obtaining unit 642, the nip width adjusting mechanism 56 or 56A moves the de-curling roller 55 or 55A to set the nip width of the nip portion NP to the second nip width wider than the standard first nip width. In this manner, a suitable de-curling force for the image area ratio is applied on the first sheet S1 having the standard first sheet thickness which is likely to be affected by the image area ratio. Thus, the first sheet S1 curled by forming an image is suitably de-curled.

The belt tension controller 644 controls the operation of adjusting the belt tension performed by the belt tension adjusting mechanism 57 or 57A. The belt tension adjusting mechanism 57 or 57A controlled by the belt tension controller 644 adjusts the tension of the endless belt 52 or 52A according to the nip width of the nip portion NP adjusted by the nip width adjusting mechanism 56 or 56A. The conveyance force applied on the sheet S passing through the nip portion NP is thereby adjusted according to the change in the nip width and kept constant. Thus, the sheet S passing through the nip portion NP is suitably conveyed.

The image forming apparatus 1 includes the de-curling device 50 or 50A capable of changing the de-curling force applied on the sheet S while suitably conveying the sheet S. Consequently, improper conveyance of a sheet, such as jamming, caused by the curl of the sheet S can be prevented.

Although the embodiments of the present disclosure are described above, the present disclosure is not limited to the embodiments and can be modified into various modes.

(1) In the embodiments described above, the de-curling device 50 and 50A capable of changing the de-curling force within the range from the force applied on the normal sheet (first sheet S1) having the standard first sheet thickness to the force applied on the cardboard (second sheet S2) having the second sheet thickness larger than the first sheet thickness are described. The de-curling devices 50 and 50A according to the present disclosure are not limited to such a configuration. The de-curling devices 50 and 50A are configured to change the de-curling force applied on the sheet according to the sheet thickness of three or more types of sheets each having a different sheet thickness (basic weight). In this case, the nip width adjusting mechanism 56 or 56A adjusts the nip width of the nip portion NP according to the number of sheets having a different sheet thickness. The belt tension adjusting mechanism 57 or 57A adjusts the tension of the endless belt 52 or 52A according to the nip width adjusted by the nip width adjusting mechanism 56 or 56A.

(2) In the embodiments described above, description has been made of an ink jet recording apparatus as the image forming apparatus 1. However, the image forming apparatus 1 of the present disclosure is not limited to the ink jet recording apparatus. As long as the image forming apparatus 1 includes the de-curling device 50 or 50A that de-curls the sheet S on which an image is formed, the image forming apparatus 1 of the present disclosure may be any apparatus employing various image forming methods (recording methods) other than an ink jet method, such as a laser beam method, a thermal method, and a wire dot method.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A de-curling device that de-curls a sheet on which an image is formed, the device comprising:

a pair of supporting rollers provided to rotate about a shaft;

an endless belt having an inner circumferential surface that is looped around the pair of supporting rollers and circulates, the endless belt further having an outer circumferential surface along which the sheet is conveyed;

a de-curling roller provided between the pair of supporting rollers and having an outer circumferential de-curling roller surface that is pressed against the outer circumferential surface of the endless belt to form a nip portion at which the endless belt curves along the outer circumferential surface of the de-curling roller, the de-curling roller being configured to de-curl the sheet passing through the nip portion;

a nip width adjusting mechanism that adjusts a nip width of the nip portion by moving the de-curling roller in a direction intersecting the outer circumferential surface of the endless belt; and a belt tension adjusting mechanism that includes a tension roller provided on an inner circumferential surface side of the endless belt, the belt tension adjusting mechanism being supported movably in a direction intersecting the inner circumferential surface of the endless belt, and being configured to apply a tension to the endless belt, and to thereby adjust a tension of the endless belt, wherein the nip width adjusting mechanism moves the de-curling roller so as to adjust the nip width within a range from a first nip width as reference to a second nip width wider than the first nip width, the belt tension adjusting mechanism includes at least one roller moving mechanism that moves at least one of the pair of supporting rollers in a direction intersecting an axial direction of the supporting roller to adjust the tension of the endless belt in proportion to the nip width adjusted by the nip width adjusting mechanism to maintain a specified conveyance force applied to the sheet passing through the nip portion.

2. A de-curling device that de-curls a sheet on which an image is formed, the device comprising:

a pair of supporting rollers provided to rotate about a shaft;

an endless belt having an inner circumferential surface that is looped around the pair of supporting rollers and circulates, the endless belt further having an outer circumferential surface along which the sheet is conveyed;

a de-curling roller provided between the pair of supporting rollers and having an outer circumferential de-curling roller surface that is pressed against the outer circumferential surface of the endless belt to form a nip portion at which the endless belt curves along the outer circumferential surface of the de-curling roller, the de-curling roller being configured to de-curl the sheet passing through the nip portion;

a nip width adjusting mechanism that adjusts a nip width of the nip portion by moving the de-curling roller in a direction intersecting the outer circumferential surface of the endless belt;

a belt tension adjusting mechanism that includes a tension roller provided on an inner circumferential surface side of the endless belt, movably supported in a direction intersecting the inner circumferential surface of the endless belt, and configured to apply a tension to the endless belt by moving in a direction intersecting the inner circumferential surface of the endless belt and adjusts a tension of the endless belt according to the nip width adjusted by the nip width adjusting mechanism to maintain a specified conveyance force applied to the sheet passing through the nip portion;

a first roller supporting holder to which the de-curling roller is mounted, the first roller supporting holder being mounted pivotally about a shaft spaced from the de-curling roller; and a nip width adjusting cam mounted rotatably relative to the first roller supporting holder and configured such that rotation of the nip width adjusting cam pivots the first roller supporting holder about the shaft and moves the de-curling roller toward or away from the endless belt and thereby adjusts the nip width.

3. The de-curling device according to claim 2, wherein the nip width adjusting mechanism moves the de-curling roller so as to adjust the nip width within a range from a first nip width as reference to a second nip width wider than the first nip width, and the belt tension adjusting mechanism reduces the tension of the endless belt in proportion to the nip width.

4. The de-curling device according to claim 3, wherein the belt tension adjusting mechanism further includes a first roller moving mechanism that moves the tension roller to adjust a tension of the endless belt without changing positions of the pair of supporting rollers.

5. The de-curling device according to claim 3, further comprising:

a first information obtaining unit that obtains sheet thickness information related to a thickness of the sheet; and a nip width controller that controls movement of the de-curling roller to control an operation of adjusting the nip width performed by the nip width adjusting mechanism, wherein when the sheet thickness information obtained by the first information obtaining unit represents a second sheet thickness larger than a standard first sheet thickness, the nip width controller moves the de-curling roller so as to set the nip width to the first nip width.

6. The de-curling device according to claim 5, further comprising:

a second information obtaining unit that obtains image area ratio information related to an image area ratio representing an area ratio of an image to the sheet, wherein when the sheet thickness information obtained by the first information obtaining unit represents the first sheet thickness, the nip width controller moves the de-curling roller so as to set the nip width to the first nip width when the second information obtaining unit obtains the image area ratio information representing a first image area ratio equal to or smaller than a predetermined area ratio, and moves the de-curling roller so as to set the nip width to the second nip width when the second information obtaining unit obtains the image area ratio information representing a second image area ratio higher than the predetermined area ratio.

7. An image forming apparatus comprising:

an image forming unit that forms an image on a sheet; and the de-curling device according to claim 2 that de-curls a sheet on which an image is formed by the image forming unit.

8. The de-curling device according to claim 2, further comprising a second roller supporting holder to which the tension roller is mounted, the second roller supporting holder being mounted pivotally about a shaft spaced from the tension roller, a belt tension adjusting cam mounted rotatably relative to the second roller supporting holder and configured such that rotation of the belt tension adjusting cam pivots the second roller supporting belt and thereby adjusts the tension of the endless belt according to the nip width adjusted by the nip width adjusting mechanism.

9. The de-curling device according to claim 8 wherein the belt tension adjusting cam is outward of the outer circumferential surface of the endless belt.

* * * * *